US005980182A

United States Patent [19]

Yen

[11] Patent Number: 5,980,182

[45] Date of Patent: Nov. 9, 1999

[54] CASE-IN DEVICE OF ADHESIVE BOOKBINDER

[75] Inventor: Tung Shang Yen, Hsi-Chih, Taiwan

[73] Assignee: Duplo USA Corporation, Santa Ana, Calif.

[21] Appl. No.: 09/102,821

[22] Filed: Jun. 23, 1998

[51] Int. Cl.[6] ..... B42C 11/04

[52] U.S. Cl. ..... 412/21; 412/17; 412/19

[58] Field of Search ..... 412/3, 4, 5, 8, 412/17, 19, 21

[56] References Cited

U.S. PATENT DOCUMENTS

| | | | |
|---|---|---|---|
| 2,895,148 | 7/1959 | Hildmann | 412/21 X |
| 3,394,418 | 7/1968 | Thorp | 412/21 |
| 5,044,857 | 9/1991 | Crudo | 412/21 X |

*Primary Examiner*—Willmon Fridie, Jr.
*Attorney, Agent, or Firm*—Rosenberg, Klein & Bilker

[57] ABSTRACT

A case-in device of an adhesive bookbinder includes a base inside which two shafts are rotatably mounted to be driven by a motor to rotate in opposite directions. A binding platform is pivotally mounted to the base and has two clamping plates movably supported thereon. The platform has two elongated slots and two guide rails corresponding to the slots. Each of the guide rails has two slides slidably mounted thereon and each corresponding to and connected through the respective slot to each of the clamping plates. Each of the slides has a roller rotatably supported thereon. The shafts have lever arms fixed thereon and the arms are sized to be engageable with the rollers and thus driving the clamping plates toward each other to clamp and the apply a force to a book disposed therebetween for adhesively securing the book cover to the book. A cam-follower pair is arranged between the platform and the base and is driven by the motor to have the platform inclined with respect to the base during a period of the book binding operation in order to facilitate positioning of the book on the platform. Biasing springs are arranged between the clamping plates and the platform to provide a normally opened condition of the clamping plates so as to receive the book placed therebetween.

7 Claims, 11 Drawing Sheets

CASE-IN DEVICE OF ADHESIVE BOOKBINDER

BACKGROUND OF THE INVENTION

1. Field of the Invention

The present invention is generally related to an adhesive bookbinder and in particular to a case-in device of the adhesive bookbinder which provides a correct and precise operation of adhesively adding a cover to a book body.

2. The Related Art

Adhesive bookbinders have been widely used to bind books, such as magazines, text books, notebooks. As shown in FIG. 2 of the attached drawings, the general procedure of binding books with an adhesive bookbinder is holding the plurality of sheets that constitute the book body (step 10'), cutting the sheets (step 11'), applying adhesive to the book body (step 12') and then adding a cover to the book body by placing the cover on the book body and applying a force thereto to have the cover adhesively secured to the book body (step 13').

Thus, a conventional adhesive bookbinder comprises holding means 10 for holding the book body, cutting means 11 for cutting the sheets, adhesive applying means 12 for applying the adhesive to the book body and cover adding means 13 for adding and securing the book cover to the book body, as is schematically shown in FIG. 1. A case-in device may be incorporated in the adhesive bookbinder to perform some of these operations and a conventional case-in device of adhesive bookbinder is shown in FIGS. 3 and 4 of the attached drawings and labelled with reference numeral 20.

As shown in FIGS. 3 and 4, the conventional case-in device 20 generally comprises a binding platform 21 and two support plates 22 and 23 fixed thereto to be spaced from each other to define therebetween a space for accommodating a driving motor 24 which is fixed to the plate 23 and two transmission shafts 28 and 29 rotatably supported between the support plates 22 and 23. A gear train 25 is arranged between the motor 24 and the two shafts 28 and 29, comprising a motor output pinion fixed to the motor spindle and two gears 26 and 27, to which the shafts 28 and 29 are respectively fixed, engaging the motor output pinion and thus driven by the motor in such a way to rotate in opposite directions. Each of the shafts 28 and 29 also has a further gear 31 or 30 fixed thereon so that the gears 31 and 30 are rotatable in opposite directions.

The binding platform 21 has two pairs of elongated slots 32 to respectively correspond to two clamping plates 33 and 34 (FIG. 4). Each of the clamping plates 33 and 34 is connected to two racks 35 via slide blocks that are movably received within and guided by the slots 32. The racks 35 are respectively engaged by the gears 26, 27, 30 and 31 so that when the motor 24 is actuated, the clamping plates 33 and 34 are driven to move relative to each other in opposite directions so as to apply force to a book and a book cover position between the clamping plates 33 and 34. A spring 36 is connected between each of the racks 35 and the binding platform 21 for biasing purpose.

Such a conventional structure of the case-in device has several drawbacks. For example, the movement of the clamping plates is caused by the engagement between the racks and the gears and is completely guided by the contact engagement between the slide blocks within the slots. Since there are always plays or backlashes between the racks and the gears, the movements of the clamping plate may become un-smooth after a long term service of the device. Further, the tolerance between the slide blocks and the slots may be getting greater with the use of the device which may finally causes undesired mechanical interference therebetween so as to result in poor control of the movement of the clamping plates. This eventually causes a quality problem in binding books.

Thus, it is desirable to have a case-in device of the adhesive bookbinder which eliminates/overcomes the problems or drawbacks encountered in the prior art.

SUMMARY OF THE INVENTION

Therefore, an object of the present invention is to provide a case-in device of an adhesive bookbinder wherein the movement of the clamping plates are guided by the sliding movements of slide blocks along guide rails so that no mechanical interference problem that has been encountered in the prior art may occur.

Another object of the present invention is to provide a case-in device wherein the gearing type mechanical coupling between the driving motor and the clamping plates is replaced by a clamping type engagement so as to eliminate the problems caused by backlashes of the gearing engagement.

A further object of the present invention is to provide a case-in device of which the binding platform may be selectively inclined to a desired angle to facilitate the positioning of the book to be bound thereon so as to increase the binding operation efficiency.

To achieve the above objects, in accordance with the present invention, there is provide a case-in device of an adhesive bookbinder, comprising a base inside which two shafts are rotatably mounted to be driven by a motor to rotate in opposite directions. A binding platform is pivotally mounted to the base and has two clamping plates movably supported thereon. The binding platform has two elongated slots and two guide rails corresponding to the slots. Each of the guide rails has two slides slidably mounted thereon and each corresponding to and connected through the respective slot to each of the clamping plates. Each of the slides has a roller rotatably supported thereon. The shafts have lever arms fixed thereon and the arms are sized to be engageable with the rollers and thus forming a clamping engagement therebetween for driving the clamping plates toward each other to clamp and the apply a force to a book disposed therebetween for adhesively securing the book cover to the book. A cam-follower pair is arranged between the binding platform and the base and is driven by the motor to have the binding platform inclined with respect to the base during a period of the book binding operation in order to facilitate positioning of the book on the platform. Biasing springs are arranged between the clamping plates and the binding platform to provide a normally opened condition of the clamping plates so as to receive the book placed therebetween.

The above objects, as well as features and advantages, of the present invention will become apparent by reading the following detailed description of a preferred embodiment thereof with reference to the attached drawings wherein:

DETAILED DESCRIPTION OF THE PREFERRED EMBODIMENT

Figure 1:
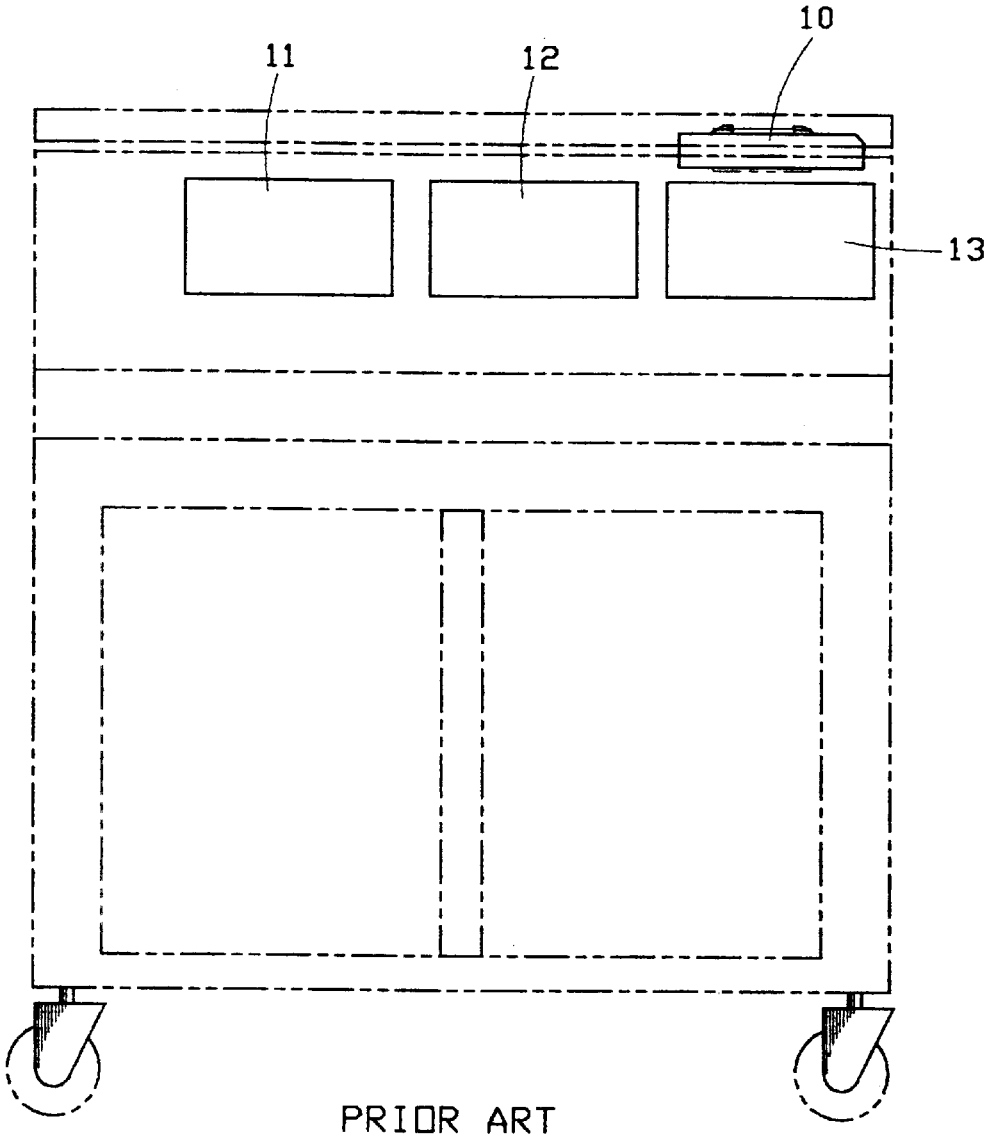
PRIOR ART FIG. 1
FIG. 1 is a schematic view of a general adhesive bookbinder.
Figure 2:
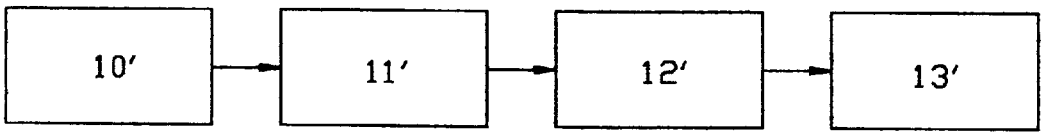
PRIOR ART FIG. 2
FIG. 2 is a flow chart showing a general process of adhesive book binding.
Figure 3:
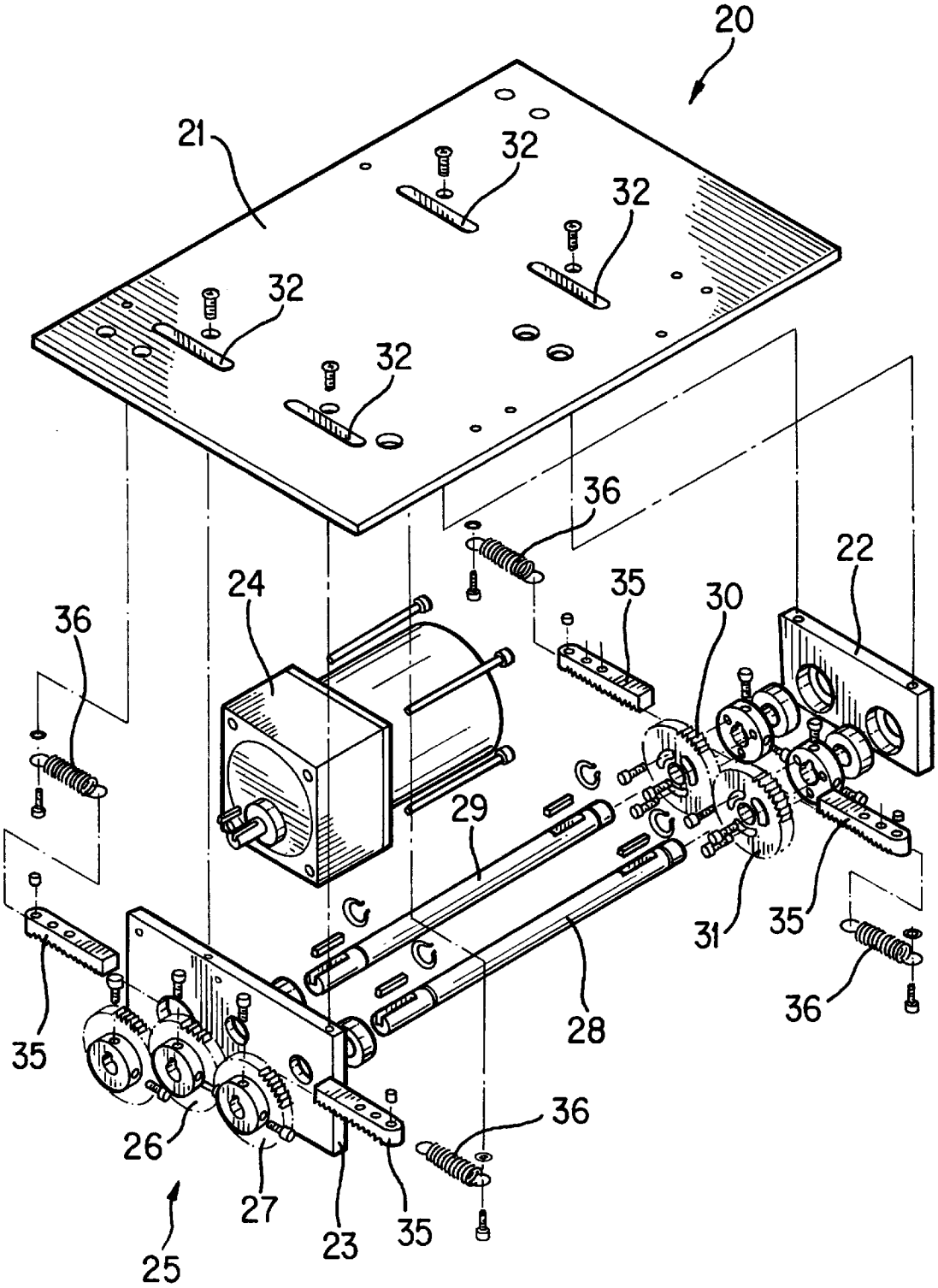
FIG. 3 PRIOR ART
FIG. 3 is an exploded perspective view showing a conventional case-in device wherein the binding platform is eliminated.
Figure 4:
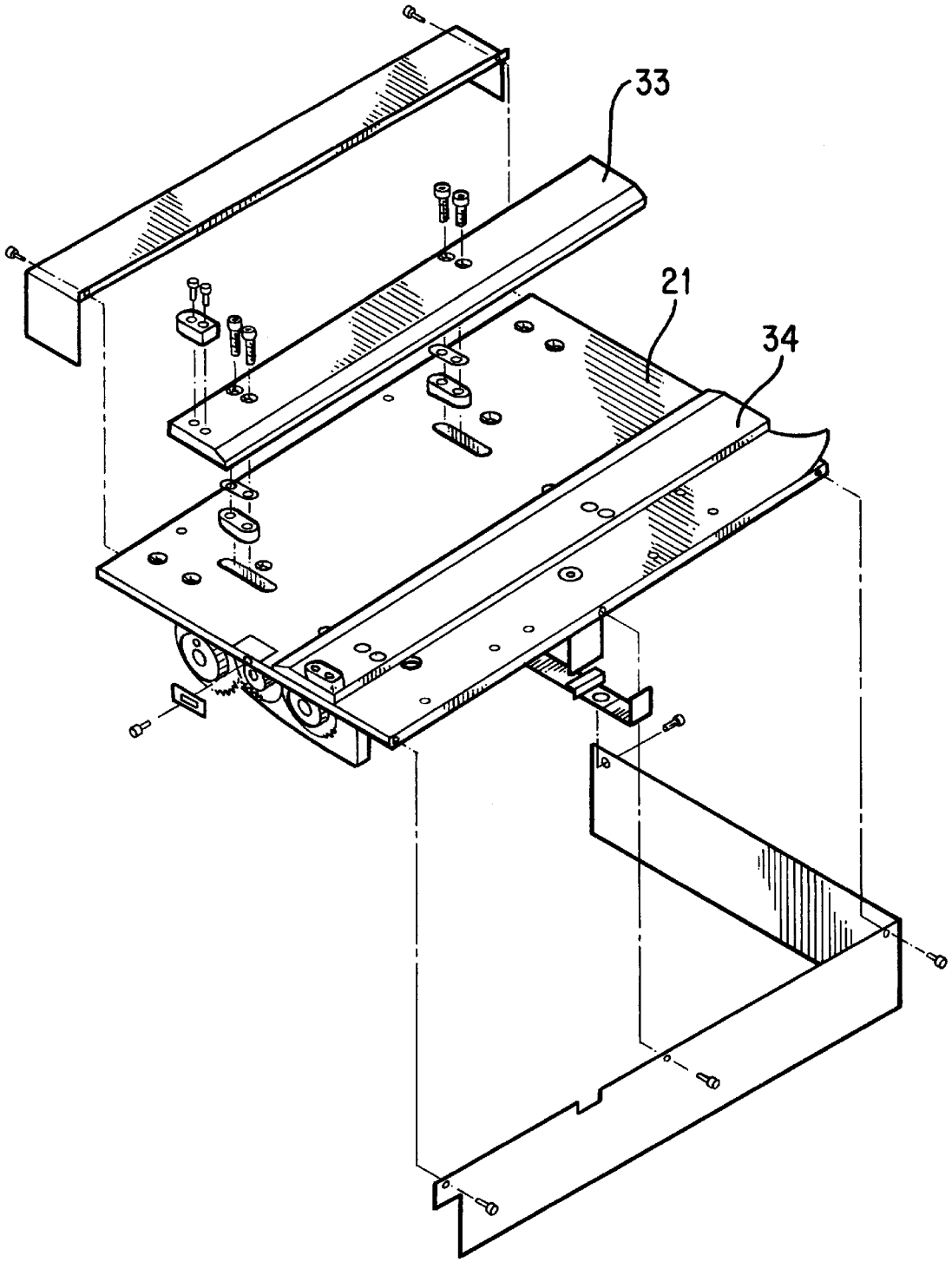
FIG. 4 PRIOR ART
FIG. 4 is a perspective view showing the conventional case-in device wherein one of the clamping plates is detached from the binding platform.
Figure 5:
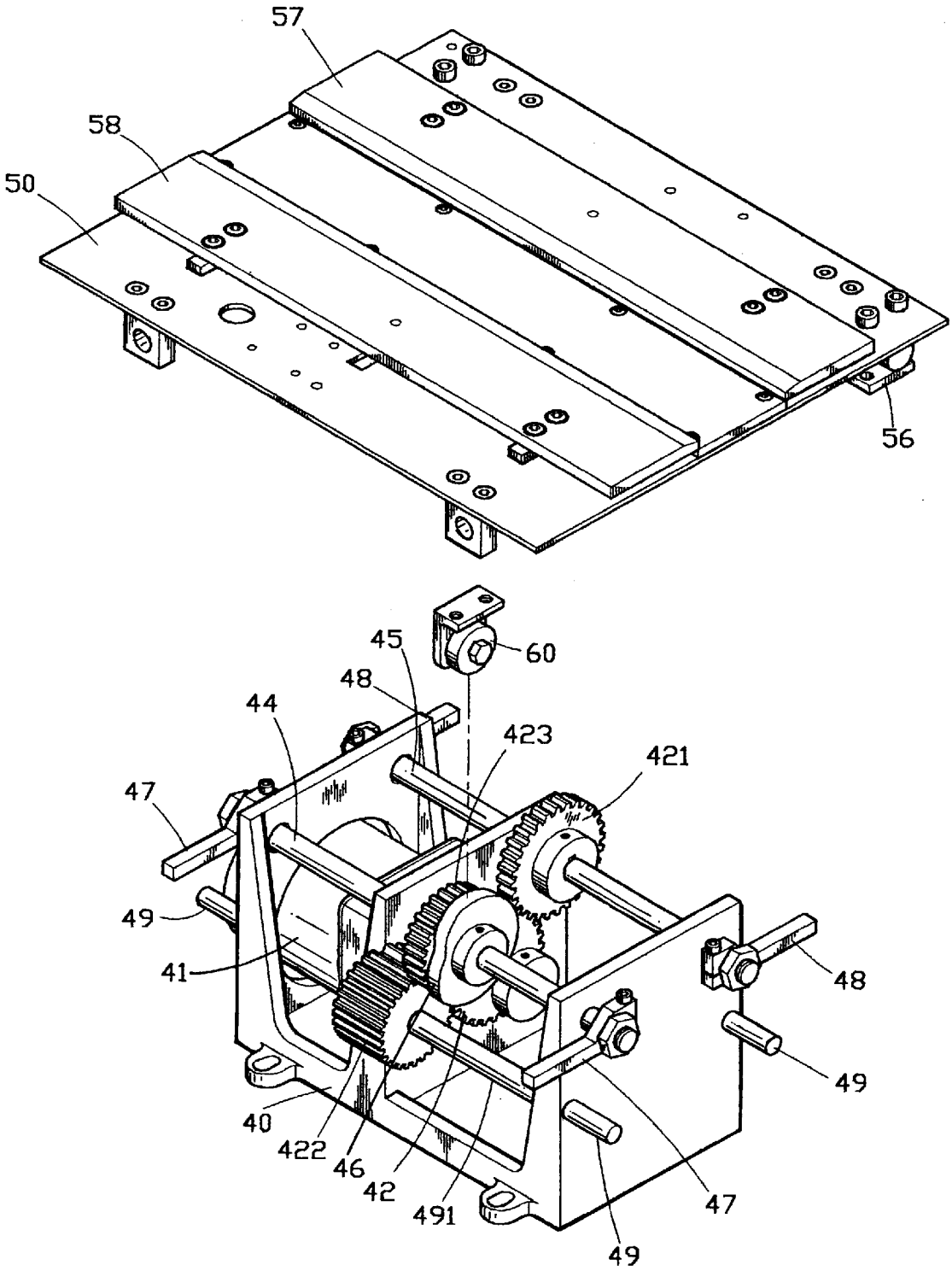
FIG. 5 is an exploded perspective view showing a case-in device of adhesive bookbinder in accordance with the present invention.

With reference to the drawings and in particular to FIG. 5 wherein a case-in device adapted to be incorporated in an adhesive bookbinder in accordance with the present invention is shown, the case-in device comprises a hollow base 40 inside which a torque motor 41 and two transmission shafts 44 and 45 that are coupled to the torque motor 41 by means of gear train are disposed and a binding platform 50 which is disposed on the base 40 and has two plate-like movable clamping members 57 and 58 movably positioned on an upper side thereof and coupled to the torque motor 41 by means of a clamping type coupling system to be driven thereby.

Figure 6:
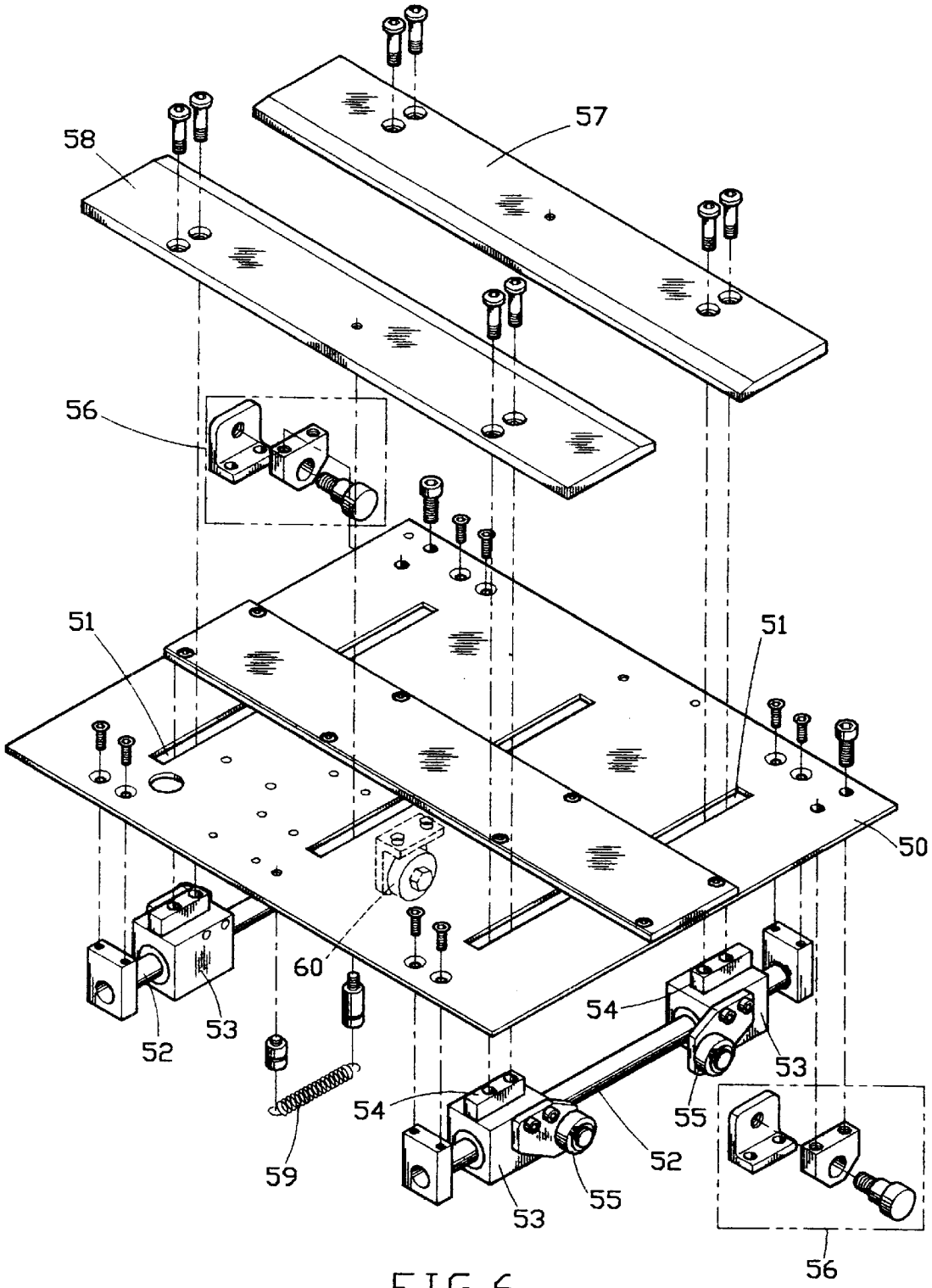
FIG. 6 is an exploded perspective view showing the binding platform of the case-in device shown in FIG. 5.

As shown in FIGS. 5 and 6, the hollow base 40 is a substantially W-shaped member having three spaced walls with two spaces defined therebetween for receiving the torque motor 41 and the transmission gear trains therein. Each of the two outside walls has two rods 49 fixed thereon and extending outward therefrom to serve as stops of which the function will be further described.

In accordance with the present invention, the torque motor 41 may comprises controlling means to allow the motor 41 to be controlled in such a way that when its rotation in a first direction is stopped or jammed for a period of for example 2-3 seconds, its rotation will be reversed in an opposite second direction. The torque motor 41 has a spindle to which a pinion 42 is fixed. The transmission gear train for the two transmission shafts 44 and 45 comprises gear 421 or 423 fixed on the shaft 45 or 44. The gear 421 directly matches the motor pinion 42, while the gear 423 is coupled to the motor pinion 42 via an idle pinion 422 (also see FIGS. 5, 11, 13 and 15) so as to be rotated in a direction opposite to the gear 421.

In the embodiment illustrated, the idle pinion 422 is mounted on a shaft 491 extending between the walls of the base 40 and preferably constituting an inward extension of one of the stop rods 49 of one of the outside walls of the base 40. However, it does not need to be so.

The two transmission shafts 44 and 45 are substantially parallel with each other and extending between and rotatably supported by the walls of the base 40. Each of the transmission shafts 44 and 45 has two ends extending out of the two outside walls of the base 40 with a lever arm 47 or 48 fixed to each of the ends to be rotatable therewith. The lever arms 47 and 48 are so dimensioned that when the motor 41 rotates in the first direction, both the transmission shafts 44 and 45 are driven to move in opposite directions and causing the lever arms 47 and 48 to get into contact with and thus stopped by the respective stop rods 49 so as to stop the rotation of the transmission shafts 44 and 45. As mentioned above, this will cause the motor 41 to rotate reversely in the opposite second direction after a 2-3 second period of stop. This will be further described.

As shown in FIG. 6, the binding platform 50 has two elongated slots 51 and two guide rails 52 are fixed to the under side of the binding platform 50 to respectively correspond to the slots 51. Each of the guide rails 52 has two slide blocks 53 slidably mounted thereon. Each of the slide blocks 53 has a projection 54 sized to be movably received within and projecting out of the corresponding slot 51 at the upper side of the binding platform 50 so as to allow the clamping members 57 or 58 fixed thereto to be movable therewith. The two slide blocks 53 on each of the guide rails 52 are respectively connected to the two clamping members 57 and 58.

Figure 7:
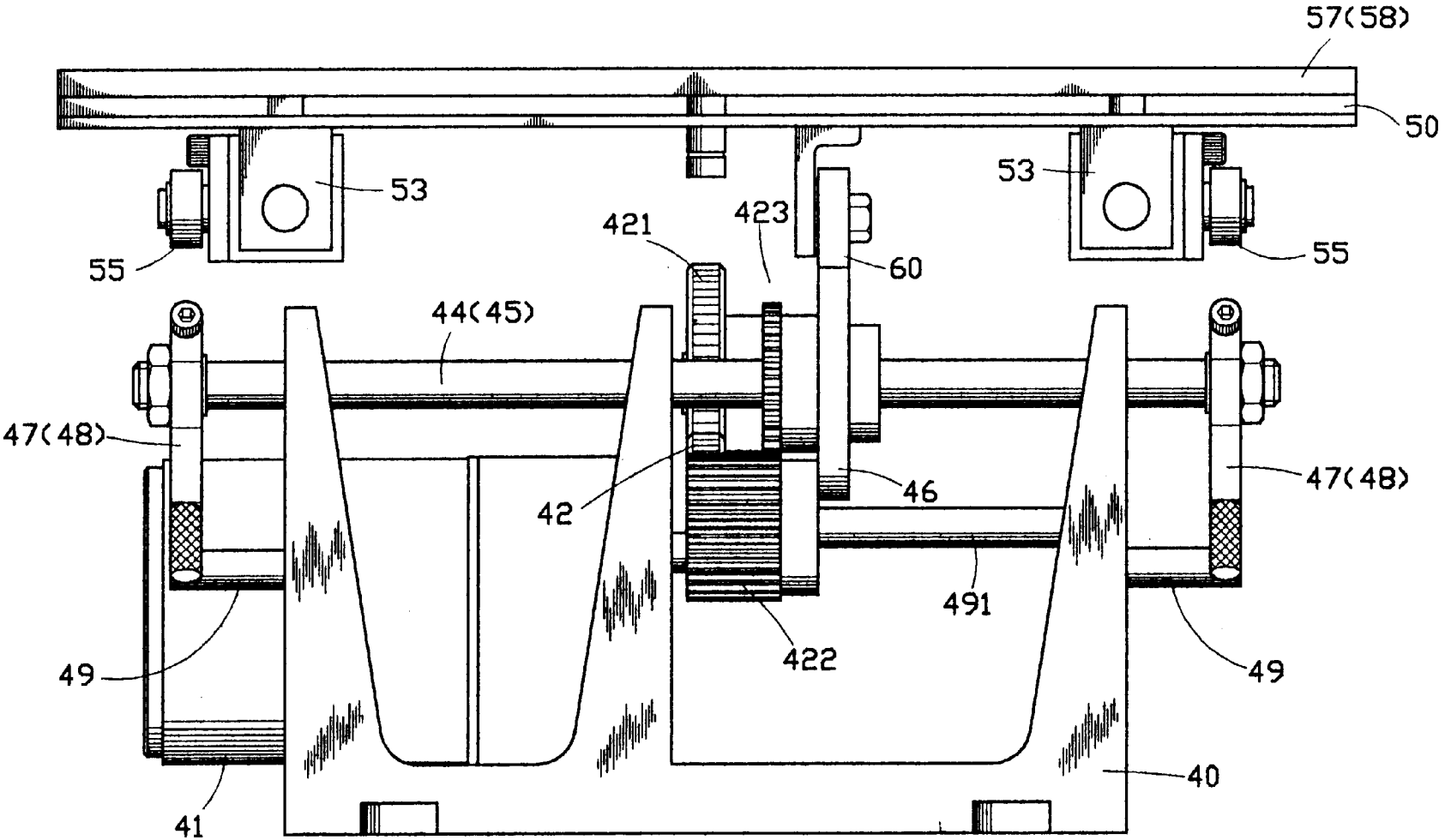
FIG. 7 is a front side view of the case-in device in accordance with the present invention.

Each of the slide block 53 has a roller 55 rotatably supported thereon and the roller 55 is located substantially corresponding to the lever arms 47 or 48, see FIG. 7, so that when the motor 41 rotates in the second direction, the lever arms 47 and 48 are brought into contact and driving engagement with the rollers 55 for driving the clamping members 57 and 58 to move in opposite directions (due to the opposite directions of rotation of the shafts 44 and 45).

Figure 8:
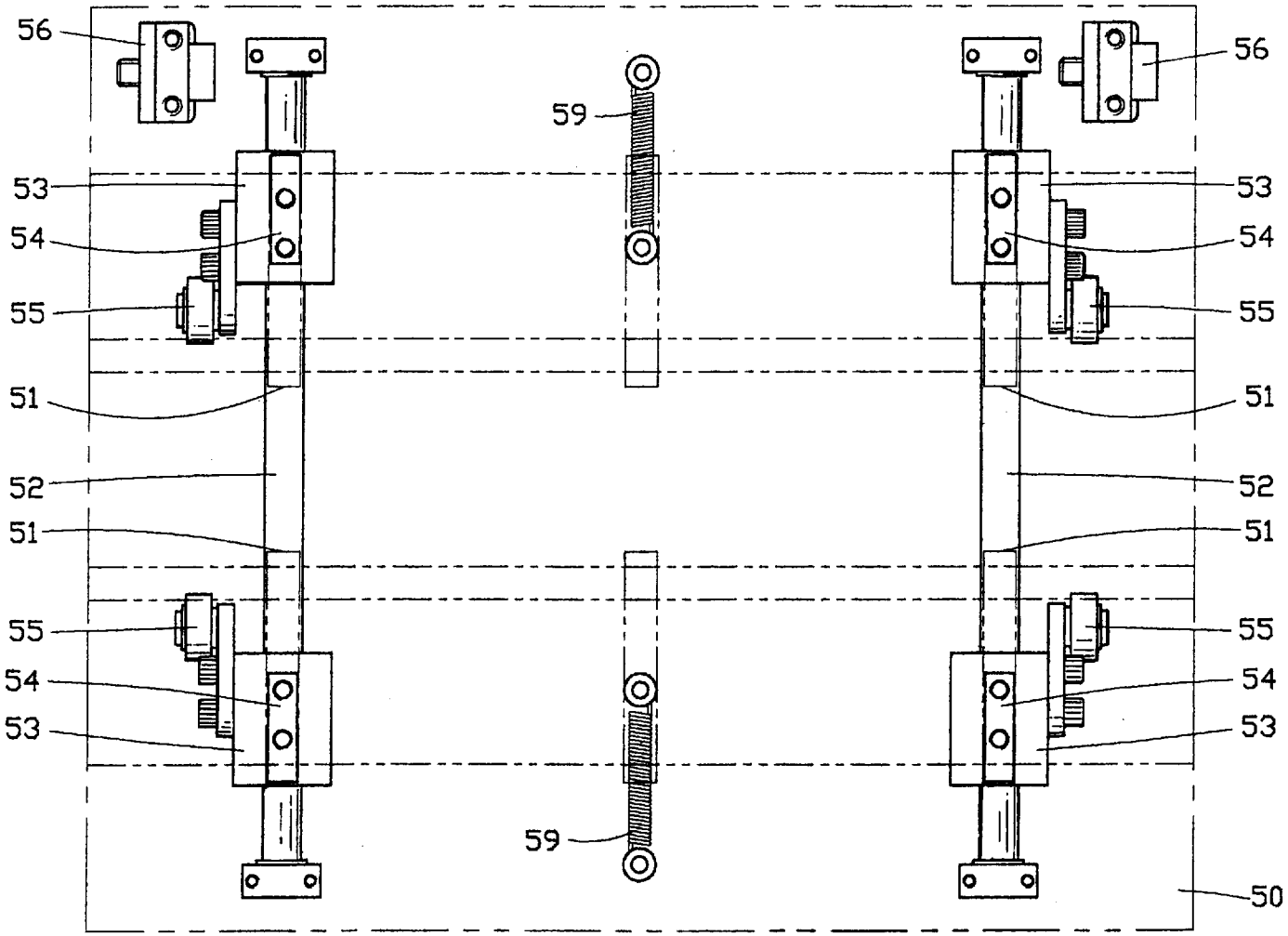
FIG. 8 is a top view of the case-in device of the present invention.

As shown in FIGS. 6 and 8, the binding platform 50 that has the two clamping plates 57 and 58 supported on the upper surface thereof comprises two pivot connections 56 which pivotally connect the binding platform 50 to the base 40 so as to allow the binding platform 50 to be rotatable about a pivoting axis defined by the pivot connections 56 and thus inclined with respect to the base 40. The binding platform 50 further comprises a roller 60, serving as a cam follower, mounted on the under side thereof. Corresponding to and engaged by the cam follower 60 (see FIG. 7), a cam 46 is rotatably supported inside the base 40 to be driven by the motor 41. In the embodiment illustrated, the cam 46 is directly mounted on one of the transmission shafts 44 and 45, which in the embodiment illustrated in shaft 44 as shown, to be driven by the motor 41. The cam 46 has such a contour that when the motor 41 is initially actuated when the binding platform 50 is assumed to be substantially horizontal, the engagement between the cam 46 and the cam follower 60 forces the binding platform 50 to inclined with respect to the base 40 by rotating the binding platform 50 about the pivot connections 56. Such an inclination is performed in an intermittent manner. In other words, the binding platform 50 may be inclined in a time period during each binding operation, namely a portion of the cycle of a book binding operation.

As mentioned above, the clamping plates 57 and 58 are movably supported on the binding platform 50 and driven by the motor 41 by means of the slide blocks 52. Each of the clamping plates 57 and 58 further comprises a biasing member, such as a spring 59, connected between the clamping plate 57 or 58 and the binding platform 50 to bias the clamping members 57 and 58 away from each other so that a normally-open condition is achieved between the two clamping members 57 and 58, see FIG. 8. Preferably the springs 59 are located on the under side of the binding platform 50 in order to avoid interference with book case-in operation.

Figure 11:
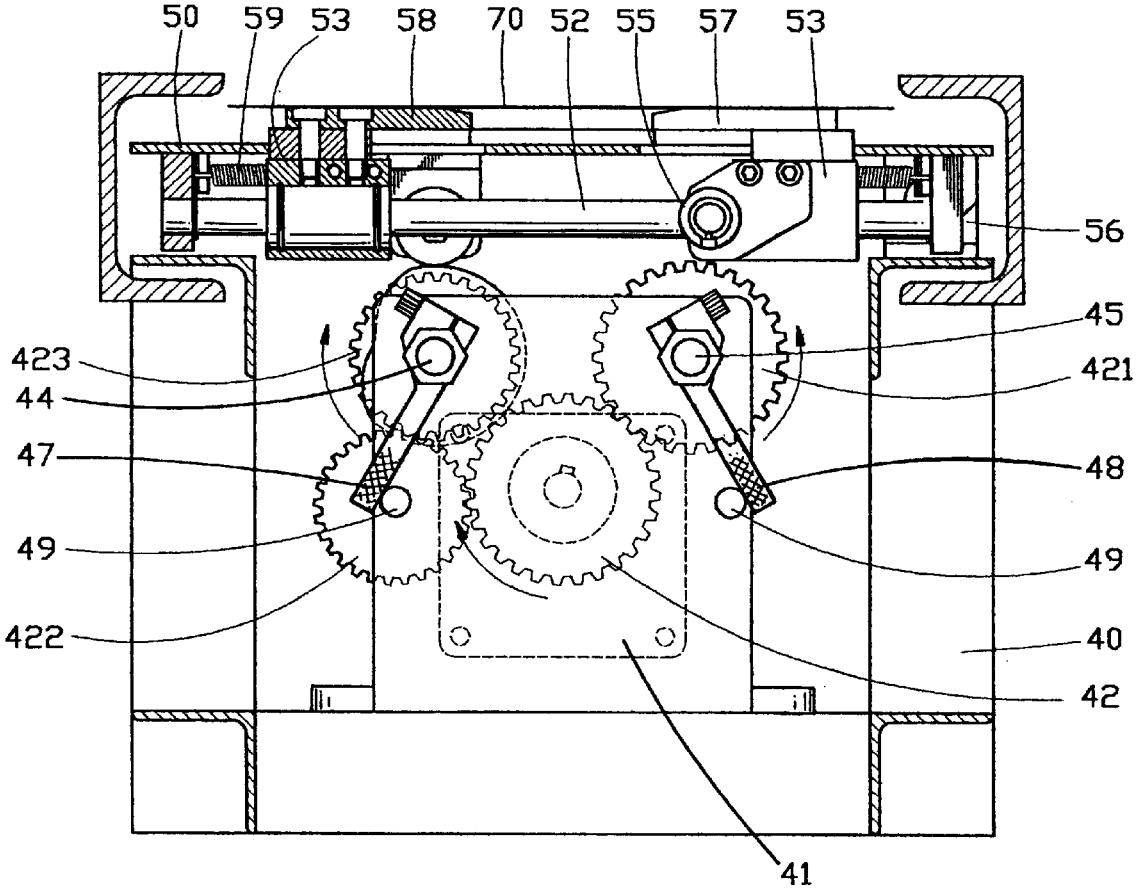
FIG. 11 is a cross-sectional view showing the condition when a book case or cover is placed on the binding platform of the case-in device of the present invention and the binding platform is substantially horizontal.
Figure 12:
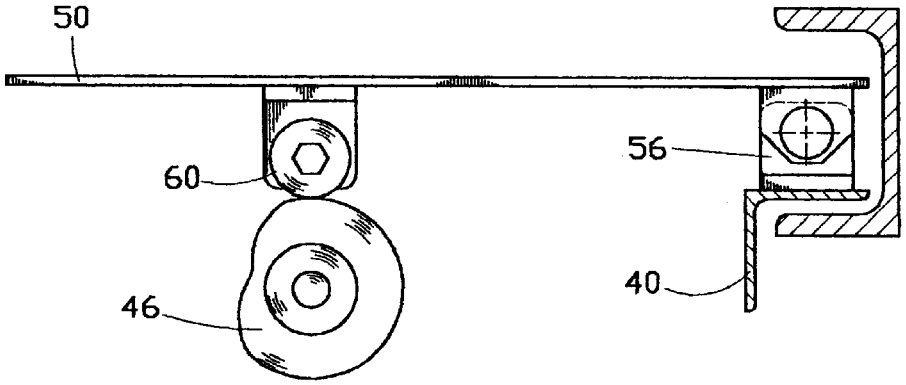
FIG. 12 is a sectional view of a portion of the case-in device showing the position of the cam and cam follower when the binding platform is in the condition shown in FIG. 11.
Figure 13:
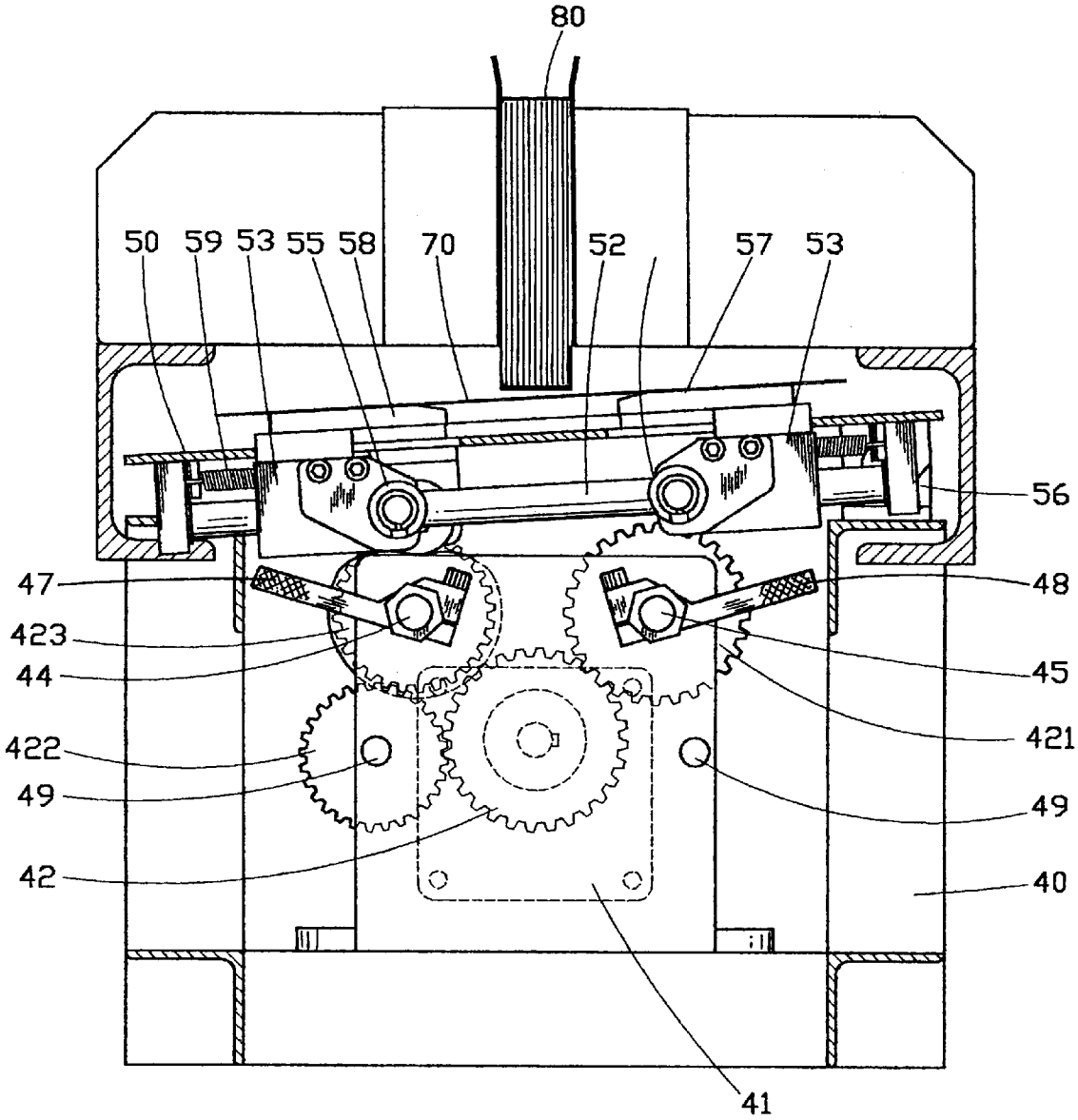
FIG. 13 is a cross-sectional view showing the condition when a book body is going to be placed on the book cover that rests on the binding platform of the case-in device of the present invention and the binding platform is inclined to facilitate the positioning of the book body on the book cover.
Figure 14:
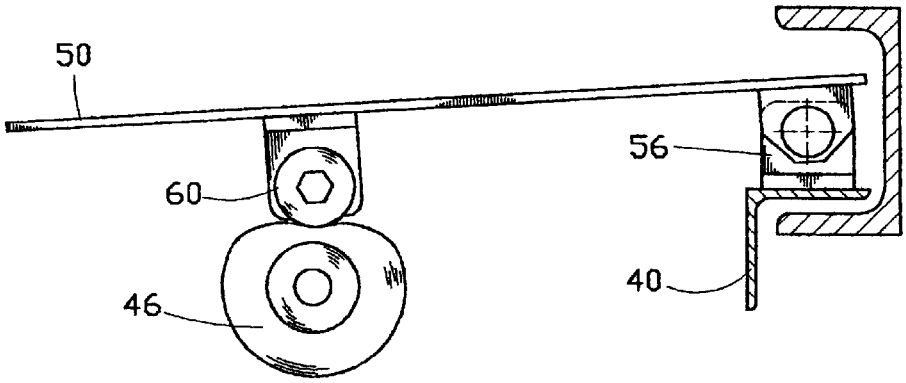
FIG. 14 is a sectional view of a portion of the case-in device showing the position of the cam and cam follower when the binding platform is in the condition shown in FIG. 13.
Figure 15:
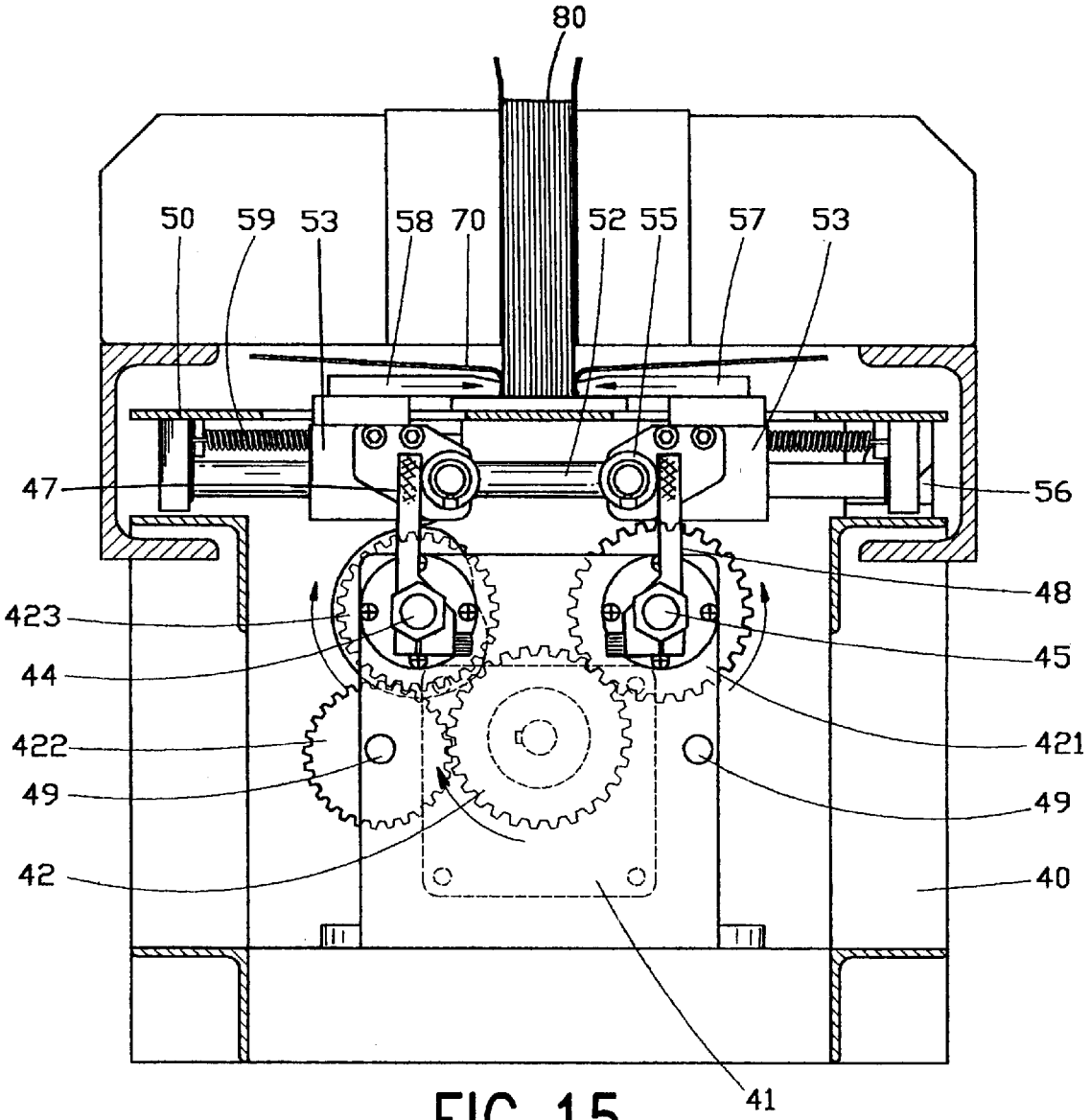
FIG. 15 is a cross-sectional view showing the condition when the book cover is clamped and thus attached to the book body by the clamping plates of the binding platform of the case-in device of the present invention and the binding platform is resuming horizontal again.
Figure 16:
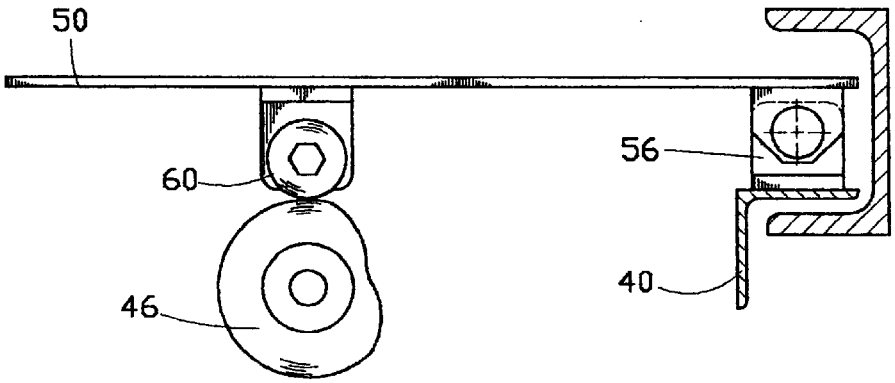
FIG. 16 is a sectional view of a portion of the case-in device showing the position of the cam and cam follower when the binding platform is in the condition shown in FIG. 15.

As shown in FIGS. 11 and 12, when the torque motor 41 is initially started and rotated in the second direction as mentioned above, the binding platform 50 is substantially horizontal or at a desired orientation depending upon the contour of the cam 46 and the clamping members 57 and 58 are in open condition. A book case or cover 70 to be added to a book body 80 is placed on the clamping plates 57 and 58. The rotation of the motor 41 causes the binding platform 50 to incline to a desired angle by means of the clamping action of the cam-follower pair (46, 60), see FIGS. 13 and 14, to facilitate the positioning of the book body 80 on the book cover 70. The book body 80 is moved downward to depress a central portion of the book cover 70 into between the two clamping plates 57 and 58 and a further rotation of the motor 41 causes the binding platform 50 back to the horizontal position, see FIGS. 15 and 16. The lever arms 47 and 48 that are driven by the transmission shafts 44 and 45 are arranged in such a way as to get into contact with the rollers 55 of the slide blocks 53 when the binding platform 50 is rotated back to the horizontal position so that a further rotation of the motor 41 drives the clamping plates 57 and 58 to move toward each other and thus clamping and applying a force to the book 80 to have the book cover 70 securely attached to the book body 80.

When the clamping plates 57 and 58 are caused to apply a clamping force to the book 80, the movement of the clamping plates 57 and 58 are substantially stopped which prevents the motor 41 from further rotation. As mentioned above, the motor 41 is controlled so that when its rotation in one direction is stopped for a period of 2-3 seconds, the motor 41 is caused to moved in an opposite direction. Thus, after the clamping force is applied to the book 80 for a period of 2-3 seconds, the motor 41 begins to rotate in a reversed direction, namely the first direction mentioned above, this releases and thus allows the book 80 to be removed out of the case-in device. In rotating in the first direction, the lever arms 47 and 48 are caused to get into contact with and stopped by the stop rods 49. Then, again the motor 41 moves in the second direction so as to begin a next cycle of book binding operation. Such an operation is automatically repeated.

Figure 9:
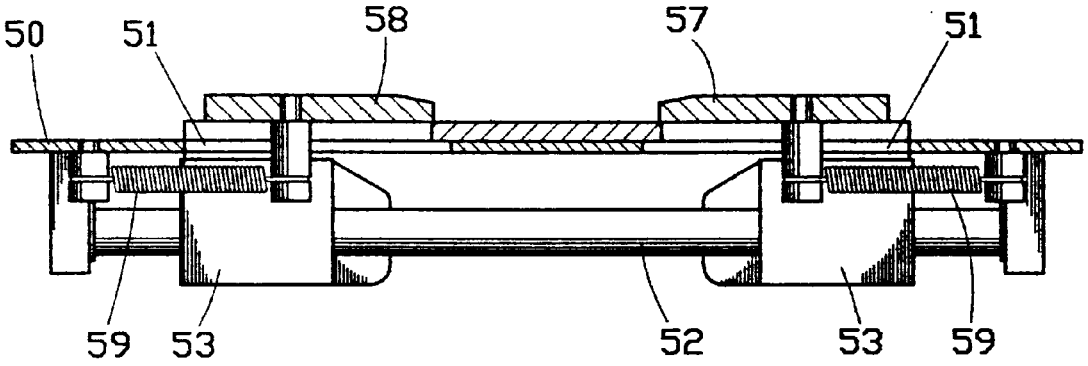
FIGS. 9 and 10 are cross-sectional views of the binding platform of the case-in device of the present invention showing the operation of the clamping plates.
Figure 10:
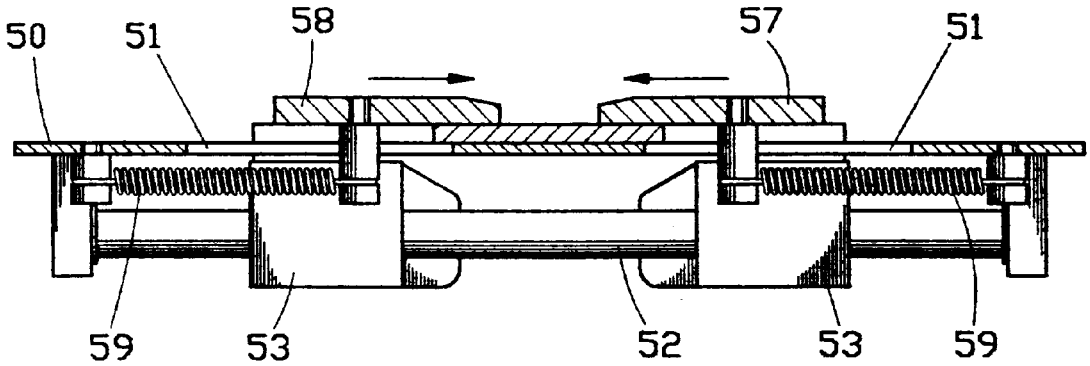

As shown in FIGS. 9 and 10, since the movement of the clamping members 57 and 58 is guided by the sliding motion of the slide blocks 53 along the guide rails 52 so that mechanical interference between the clamping members 57 and 58 and the slots 51 of the binding platform that is usually encountered in the prior art may be eliminated. A more smooth operation of the case-in device may be obtained and the service life may be extended.

Although a preferred embodiment has been described to illustrate the present invention, it is apparent that changes and modifications in the specifically described embodiment may be carried out without departing from the scope of the invention which is intended to be limited only by the appended claims. For example, there may be only one elongated slot formed on the binding platform and correspondingly, the platform has only one guide rod to movably suppport the slidable blocks that couple the clamping plates to the transmission shafts via a single lever arm on each of the shafts. Of course, the stop rods provided on the outside walls of the base may not be needed on both outside walls.

What is claimed is:

1. A case-in device adapted to be incorporated in an adhesive bookbinder to adhesively attach a book cover to a book body, the case-in device comprising:

a hollow base having two side walls, at least one of which having two stop rods mounted thereon;

a torque motor fixed inside the hollow base and having an output pinion, the torque motor being capable to rotate in two opposite directions and comprising means for controlling the motor so that once the rotation of the motor in a direction is stopped for a given period of time, the motor is rotated in a reversed direction;

two shafts rotatably supported inside the base and respectively coupled to the output pinion of the torque motor by means of gear train so as to be rotatable in opposite directions, each of the two shafts having at least a lever arm attached thereto to be rotatable in unison therewith and sized to be engageable with the respective one of the stop rods mounted on the side walls of the base when the motor is rotated in a first direction so as to stop the rotation of the motor in the first direction;

a binding platform mounted on the base and having an upper side on which two clamping plates are movably supported with a variable spacing between the two clamping plates and an under side, the binding platform having at least one elongated slot thereon and at least one guide rail fixed to the under side of the platform to be corresponding to the slot, the guide rail having two slide blocks slidably mounted thereon and respectively connected to the clamping plates via the slot, each of slide blocks comprising a roller which is engageable by the lever arm of the respective one of the shafts when the motor is rotated in a second direction that is opposite to the first direction and thus driven by the lever arm to have the clamping plates that are fixed to the slide blocks to move in a direction toward each so as to reduce the spacing between the clamping plates to clamp the book cover and the book body therebetween; and biasing means for biasing the clamping plates away from each other to maintain an opened condition.

2. The case-in device as claimed in claim 1, wherein the biasing means comprises a spring connected between each of the clamping plates and the binding platform to bias the clamping plates away from each other.

3. The case-in device as claimed in claim 1, wherein the binding platform is pivotally mounted on the base to be rotatable with respect to the base about a pivoting axis and wherein a cam-follower mechanism is provided between the base and the binding platform and driven by the motor so as to rotate the binding platform about the pivoting axis for inclining the binding platform with respect to the base in a predetermined period of a book binding cycle of the case-in device.

4. The case-in device as claimed in claim 3, wherein the cam is rotatably supported inside the base and driven by the motor and the cam follower is fixed to the platform and engaged by the cam, the cam having a cam contour so that when the binding platform is inclined with respect to the base in the predetermined period.

5. The case-in device as claimed in claim 4, wherein the cam in mounted on one of the shafts.

6. The case-in device as claimed in claim 1, wherein the binding platform comprises two elongated slots and two guide rails fixed to the underside thereof to respectively correspond to the two slots, each guide rail having two slide blocks slidably mounted thereon and each slide block having a roller rotatably supported thereon, each of the shafts having two lever arms fixed thereon to be respectively engageable with the rollers of the slide blocks of the two guide rails, both the two side walls of the base having two stop rods to be engageable by the lever arms of the shafts when the motor is rotated in the first direction.

7. The case-in device as claimed in claim 1, wherein the motor is initially started in the second direction to drive the clamping plate toward each other so as to clamp and the bind the book cover and the book body between the clamping plates which provides stopping means to stop the rotation of the motor in the second direction and thus reverse the rotation of the motor to the first direction, the stop rods of the base serving as further stopping means which stops the motor rotation in the first direction and thus reverses the motor rotation to the second direction again so as to allow the book binding operation to be repeated continuously.

* * * * *